United States Patent [19]

Wilkinson

[11] 4,325,378

[45] Apr. 20, 1982

[54] SPORTS GARMENT

[76] Inventor: Margaret Wilkinson, 103 Grant Rd., Landsdale, Pa. 19446

[21] Appl. No.: 141,869

[22] Filed: Apr. 21, 1980

[51] Int. Cl.[3] ..... A41C 3/02

[52] U.S. Cl. ..... 128/501; 128/482

[58] Field of Search ..... 128/501, 482, 483, 503

[56] References Cited

U.S. PATENT DOCUMENTS

| | | | |
|---|---|---|---|
| 1,242,118 | 10/1917 | Anderman | 128/501 |
| 1,545,441 | 7/1925 | Newman et al. | 128/501 |
| 2,869,552 | 1/1959 | Smith | 128/501 |
| 2,970,597 | 2/1961 | Michel | 128/501 |

FOREIGN PATENT DOCUMENTS

| | | | |
|---|---|---|---|
| 857747 | 1/1961 | United Kingdom | 128/501 |

*Primary Examiner*—Doris L. Troutman

*Attorney, Agent, or Firm*—Steele, Gould & Fried

[57] ABSTRACT

A womens' sports garment, in the general form of a brassiere, for use when engaged in physical activity, and in particular, jogging. The garment provides support, and at the same time, protects the wearer from experiencing discomfort or injury caused by excessive breast movement. The garment comprises an inner liner and outer breast supporting flaps overfitting the liner, the inner liner and outer flaps being independently displaceable, at least in the area adjacent the breasts, and the flaps being adjustably cinchable. The liner may be provided with breast engaging pockets in the general form of a brassiere. The liner may have shoulder straps and may also have an elastic member disposed below the supporting pockets. The two supporting flaps may be connected to the lining behind the breast engaging pockets. When the flaps are cinched together an inward pressure, independent of any vertical loads caused by the weight of the breasts, is created, thereby preventing excessive movement. Movement of the liner, independently of the supporting flaps, substantially eliminates irritation due to chafing.

6 Claims, 6 Drawing Figures

SPORTS GARMENT

BACKGROUND OF THE INVENTION

This invention relates to sports garments in general, and in particular to a sports garment for women which provides comfortable breast support during physical activity, by preventing excessive breast movement, and which substantially eliminates irritations from chafing and the like, which would otherwise result from those movements of the breast which cannot be prevented.

As exercise and physical fitness in general become more popular in the United States, women who engage in this activity often experience pain and discomfort caused by breast movement. One form of discomfort results from chafing and rubbing of the breasts and nipples against clothing. Such a condition associated with jogging has been identified, and designated as "Jogger's Nipple". Sagging and tearing of breast tissue can also occur when breasts are inadequately supported during exercising and sports activity.

As an avid jogger, I sought a garment which would provide the necessary support and comfort. I determined rather quickly that conventional brassieres, even those purportedly designed for sports activities, were incapable of providing the type of support and protection required. I experimented by wearing two conventional brassieres simultaneously. Notwithstanding the trials of uncounted numbers of combinations of conventional brassieres, I was unable to produce a suitable, convenient to use arrangement. I learned that many combinations seemed comfortable at first, providing ample support, but that after a time, a certain looseness developed. This looseness completely negated the initially beneficial effects, and could not be compensated for. It became apparent that a novel arrangement would be necessary. As I considered the problem, I noted that vigorous physical activity resulted in substantial losses of body fluids, primarily through sweating. A curious effect of this fluid loss, particularly in women, is a decrease in the size and/or fullness of the breasts. Other conditions as well are known which cause changes in breast size. Working from my initial considerations of a double layer or double brassiere configuration, I constructed a garment along those lines. The inner brassiere or liner was made from a soft, smooth material, preferably fastening in front, as in many conventional brassieres. The outer brassiere, or flaps overfitting the breasts, was made from a stronger material. In place of a conventional clasp, the outer flaps were provided with an easily adjusted cinchable connection, so that the desired amount of supporting pressure could be provided. As physical activity commenced, causing the breasts to become smaller, and causing the garment material to stretch, I found it an easy matter to release the connection of the outer flaps, and recinch them tighter, as often as necessary. Most ,women wear pullover shirts or sweat shirts while exercising, meaning that adjustment of a brassiere requires a cessation of a physical activity in a place of reasonable privacy. When wearing my invention while jogging, I am able, for example, to simply reach under my shirt and adjust the garment without stopping and without being embarrassed. By permitted independent movement of the inner layer and outer flaps of my invention, the inner layer protects against chafing and the outer flaps protect against tissue damage. The cinchable connection assures that ample support can be maintained throughout the period of physical activity.

The use of a double layer construction in conventional foundation garments, such as corsets, is known. For example, U.S. Pat. No. 1,659,281 discloses a garment having a back part and a front part which contains stiffening members, elastic inserts between both parts, and a covering for the front part formed by an extension of the back part from either side of its point of attachment to the front part.

U.S. Pat. No. 1,240,510 discloses a corset which combines a brassiere formed of two members, the front edges of which attach together, and an extensible fabric connecting the back edges to the inner back of the corset, each member extending a suitable distance above and below the upper edge of the corset.

My invention comprises an inner liner and outer breast supporting flaps overfitting the liner, the inner liner and outer flaps being independently displaceable, at least in the area adjacent the breasts, and the flaps being adjustably cinchable.

Despite the use of a double layer construction, neither of these references suggests the use of a lining having breast engaging pockets which is overfitted by interconnecting breast supporting flaps, the lining and flaps being independently displaceable, at least in the area adjacent the breasts. The above references provide breast support in a manner which either merely flattens or lifts. Neither reference provides the inward pressure which is created by applicant's invention and neither provides protection against chafing. The noted references also deal primarily with flattening the abdominal area and breast support seems to be only a secondary consideration.

SUMMARY OF THE INVENTION

It is an object of this invention to provide a sports garment which can protect against the development of physical problems, caused by breast movement, while engaged in physical exercise or sports activity.

It is another object of this invention to provide a garment, in the general form of a brassiere, having an inner liner and supporting flaps overfitting the liner, the liner and supporting flaps being independently displaceable, at least in the area adjacent the breasts.

It is a further object of this invention to provide a garment as described, wherein the supporting flaps may be adjustably cinched.

It is yet a further object of this invention to provide a garment as described which inhibits excessive breast movement and substantially eliminates irritations caused by chafing, wherein the cinching force required, to inhibit excessive movement is both adjustable, and independent of vertical loads due to the weight of the breasts, and wherein protection adainst chafing is provided irrespective of the cinching force.

It is yet a further object of this invention to provide a garment as described wherein the cinching force may be easily adjusted, during the course of physical activity and without the need for privacy.

Briefly, these and other objects are accomplished in accordance with the principles of this invention by use of a garment in the general form of a brassiere comprising an inner liner and outer breast supporting flaps overfitting the liner, the inner liner and outer flaps being independently displaceable, at least in the area adjacent the breasts, and the flaps being adjustably cinchable. The liner may be provided with breast engaging pockets in the general form of a brassiere. The liner may have shoulder straps and may also have an elastic member disposed below the supporting pockets. The two supporting flaps may be connected to the lining behind the breast engaging pockets. When the flaps are cinched together an inward pressure, independent of any vertical loads caused by the weight of the breasts, is created, thereby preventing excessive movement. Movement of the liner, independently of the supporting flaps, substantially eliminates irratation due to chafing.

The flaps secure in front in a manner which allows for easy cinching. In one preferred embodiment, one flap is provided with a tapered section, which is passed through a loop attached to the other flap, and secured back on itself, by Velcro fasteners or the like. The further the tapered section is cinched or pulled through the loop before being secured, the more inward pressure or compression force is placed on the breasts.

Persons wearing a sports garment constructed in accordance with the principles of this invention are able to engage in vigorous physical activity, while being protected from problems which would otherwise develop as a result of undesirable breast movement.

BRIEF DESCRIPTION OF THE DRAWINGS

For the purposes of illustrating the invention, there are shown in the drawings forms which are presently preferred; it being understood, however, that this invention is not limited to the precise arrangements and instrumentalities.

DETAILED DESCRIPTION OF THE PREFERRED EMBODIMENT

Figure 1:
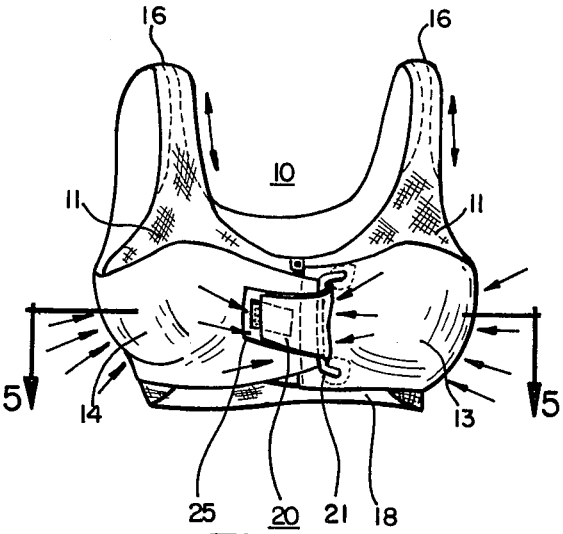
FIG. 1 is a front perspective view of a garment according to the present invention, in secured condition.
Figure 2:
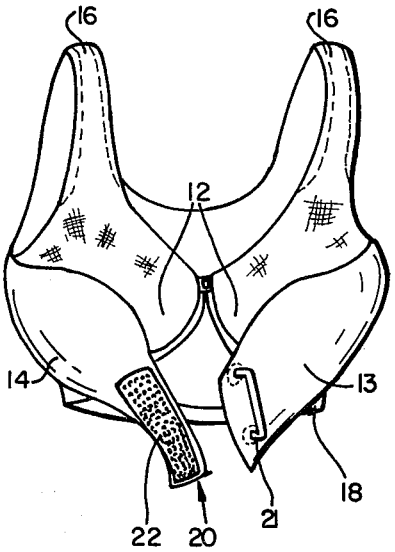
FIG. 2 is a front perspective view according to the present invention, in unsecured condition.
Figure 3:
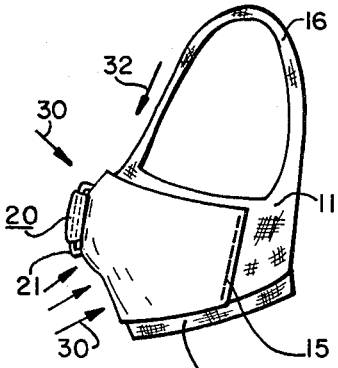
FIG. 3 is a side view of FIG. 1.
Figure 5:
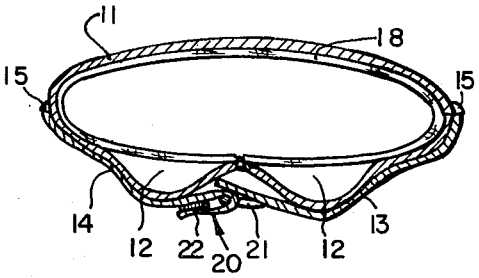
FIG. 5 is a section view taken along the line 5—5 of FIG. 1; and, FIG. 6 is a section view similar to FIG. 5 but further cinched.
Figure 6:
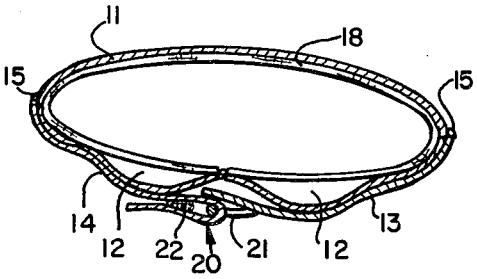

A women's sports garment in accordance with this invention, for use by women while engaged in physical activity, such as exercise and sports is shown in FIG. 1 and generally designated by numeral 10. In the presently preferred embodiment, the garment is in the general form of a brassiere. The garment comprises an inner liner 11, which is preferably made from any soft, smooth, or otherwise suitable fabric, and may either be pulled down over the head or have a conventional detachable connection means 23 at the front thereof and joined at the back along seam 19. The liner 11 may be formed with breast engaging pockets 12, formed in the manner well known in the art for construction of conventional brassieres. As can best be seen in FIGS. 2 and 3, breast engaging pockets 12 are overfitted by two breast supporting flaps 13 and 14. Flaps 13 and 14 are preferably made from a heavier and/or stronger fabric than that of liner 11. The flaps, in the presently preferred embodiment, are secured together, or interconnected by passing a tapered section 20, at the end 25 of flap 14, through a loop 21, attached adjacent the end 27 of flap 13. As the tapered section 20 is further pulled or cinched through the loop 21, and, attached back on itself, an inward pressure or compressive force is created, pressing the breasts toward the chest, and somewhat toward one another, as shown in FIG. 6. As this cinching action increases, breast movement becomes more constrained. With reference to FIG. 2, the breast supporting flap 13 may be secured to the liner 11, by stitching or other suitable attachment means 15, at a point behind the pocket 12. Flap 14 may be secured in a fashion similar to flap 13, as shown in FIGS. 5 and 6. In this embodiment liner 11 is also provided with shoulder straps 16. The inward pressure or compressive force created by cinching flaps 13 and 14, designated by arrows 30, as shown in FIG. 3, is independent of any vertical loads, designated by arrows 32, due to downward pressure exerted by the weight of the breasts. Thus, the flaps are effective, and the garment is effective, even when in the form of what is conventionally termed a strapless brassiere. In either construction, the dangers of sagging or torn breast tissue is substantially eliminated.

Notwithstanding the supporting pressure exerted by flaps 13 and 14 when cinched, liner 11 and flaps 13 and 14 are independently displaceable with respect to one another, at least in the area adjacent the breasts and breast engaging pockets 12. The ability of the liner 11 to move relative to flaps 13 and 14, even when cinched, provides protection for the breast against irritations caused by chafing which would otherwise result from that movement of the breasts which is not fully constrained by flaps 13 and 14.

An elastic member 18 may be disposed below the breast engaging pockets, attached to the bottom of lining 11. This elastic member functions primarily to keep the liner 11 against the body in a streamlined fashion. Elastic member 18 may also provide a small measure of breast support.

When tapered section 20 of flap 14 is pulled back on itself, to cinch flaps 13 and 14, releasable and adjustable fastening means 22, such as a VELCRO fastener, are used to secure the flaps. The cinching of flaps 13 and 14 is shown in FIGS. 1 and 5, and in particular, FIG. 6. As looseness develops the releasable and adjustable fastening means 22 allows for easy adjustment of the cinching pressure, even when the wearer is in the midst of physical activity. Further, this adjustment can be made in public, without the need to undress and without exposing the breasts.

The liner 11 may contain a fastening means 19, as shown in FIGS. 3, 5 and 6, which allows for a conventional detachable connection of the garment. In an alternative, the lining may be placed on the body by pulling the garment down over the head as would be necessary with the embodiments shown in FIGS. 2 and 4.

Figure 4:
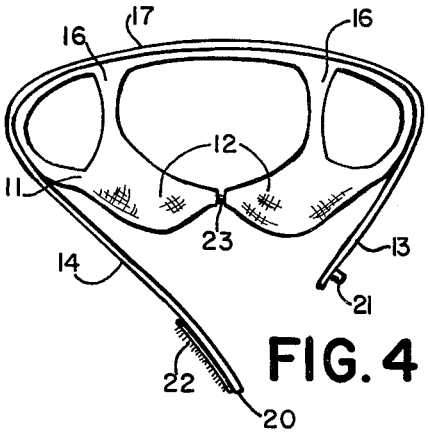
FIG. 4 is a top view of FIG. 2, but illustrating a modified outer flap structure.

Flaps 13 and 14 may take forms other than separate flaps attached to the sides of liner 11, as is the case in FIGS. 1–3, 5 and 6. Another such embodiment is illustrated in FIG. 4. In FIG. 4, the adjustable breast supporting flaps are the ends of a single band member 17, which is connected to the back of liner 11 by suitable attachment means. Such suitable or attachment means may comprise or be formed integrally with seam 19. In this embodiment the liner 11 may be a continuous band, notwithstanding connection means 23, as shown, for example, in FIGS. 2 and 6. In a still further embodiment, not shown, a single band member 17 may be utilized and the liner may not be a continuous band member, but may be attached to the sides of the garment, by connection means similar to connection means 15, and extend over only the front of the garment.

If, as a result of the particular physical activity engaged in, or as a result of normal wear and tear, one of the liner and flaps or band member wears excessively with respect to the other, connection means 15 may comprise zippers or the like, to facilitate replacement of only the worn member.

Although this invention has been described in connection with women, it should be understood that certain men, as a result of age, sickness or internal physical ailments or conditions, experience breast development beyond that which is considered average or normal. This invention is also suitable for use by such men as well.

The unique advantages of this invention might best be appreciated in the context of a women running or jogging. The rhythmic reciprocating or bouncing movements of the trunk or chest will cause the breasts to bounce up and down. Further, shocks transmitted through the body from repetitive foot strikes will result in additional breast movement or vibration. If a women runs without any breast supporting garments breast movement will be maximum and excessive, resulting eventually in sagging and torn supporting tissue. If a shirt, sweatshirt or blouse of some kind is worn, the breasts, and the nipples in particular, will chafe against the fabric causing the irritation condition known as "Jogger's Nipple". Of course, this condition is also aggravated by movement of the fabric relative to the breasts.

If a woman wears any kind of conventional brassiere, breast movement will still be excessive, even if marginally restrained, and chafing can still occur, particularly if the brassiere is simply a reinforced version of a conventionally designed brassiere, which the present invention is not.

When a woman wears a garment in accordance with this invention, the inner liner protects the breasts and nipples from chafing notwithstanding the compressive or cinching force which is applied to the breasts by tightening the front flaps. As noted, the liner and supporting flaps are capable of relative displacement, independently of each other. Accordingly, the outer flaps are effective in eliminating excessive breast movement, preventing tissue damage and consequently sagging, and the liner is effective in preventing chafing which would otherwise result from that remainder of breast movement which is not constrained, and from vibratory movement of the breasts due to shocks from foot strikes, which would be present even if breast movement were virtually completely eliminated.

The present invention may be embodied in other specific forms without departing from the spirit or essential attributes thereof, and, accordingly, reference should be made to the appended claims, rather than to the foregoing specifications as indicating the scope of the invention.

I claim:

1. A sports garment for protecting and supporting the breasts of a person engaged in physical activity, comprising:

a torso encircling inner liner having breast receiving pockets and shoulder straps;

an elastic member disposed along the bottom of the inner liner, the inner liner being so shaped that the elastic member is disposed, in use, against the torso and along the curve of the breasts;

breast supporting flaps attached to the inner liner at points behind each of the breast receiving pockets respectively, the flaps overfitting the breast receiving pockets, the breast receiving pockets being nevertheless independently displaceable relative to the flaps; and, means for releasably and adjustably cinching the flaps together, the cinched flaps being substantially fixed in position relative to the torso, whereby the flaps provide an inwardly directed pressure for constraining excessive and harmful breast movement and the breast receiving pockets of the inner liner move together with the breasts and provide protection against chafing from breast movement not restrained by the flaps.

2. The garment of claim 1, wherein said flaps are opposite ends of a single member.

3. The garment of claim 2, wherein said liner is secured to said band.

4. The garment of claim 1, further comprising a tapered section terminating one of said flaps and an attachment loop adjacent the end of the other of said flaps, said tapered section being insertable through said loop.

5. The garment of claims 1 or 4, wherein said releasable and adjustable cinching means comprises loop pile fastening means.

6. The garment of claim 1, further comprising detachable fastening means disposed at the front of the liner.

* * * * *